United States Patent [19]

Allen

[11] 4,410,216

[45] Oct. 18, 1983

[54] METHOD FOR RECOVERING HIGH VISCOSITY OILS

[75] Inventor: Joseph C. Allen, Bellaire, Tex.

[73] Assignee: Heavy Oil Process, Inc., Dallas, Tex.

[21] Appl. No.: 267,469

[22] Filed: May 27, 1981

Related U.S. Application Data

[63] Continuation of Ser. No. 108,815, Dec. 31, 1979, abandoned, which is a continuation-in-part of Ser. No. 940,390, Sep. 7, 1978, Pat. No. 4,257,650.

[51] Int. Cl.[3] ..... E21B 43/24; E21B 43/30; E21B 47/00; E21C 41/10

[52] U.S. Cl. ..... 299/2; 166/50; 166/245; 166/252; 166/263; 166/272

[58] Field of Search ..... 166/50, 57, 62, 245, 166/256, 257, 261, 263, 272, 302, 303, 274, 252; 299/2

[56] References Cited

U.S. PATENT DOCUMENTS

| | | | |
|---|---|---|---|
| 1,816,260 | 7/1931 | Lee | 166/50 X |
| 2,171,416 | 8/1939 | Lee | 166/50 X |
| 2,897,894 | 8/1959 | Draper et al. | 166/272 |
| 3,024,013 | 3/1962 | Rogers et al. | 166/302 X |
| 3,040,809 | 6/1962 | Pelzer | 166/303 |
| 3,153,448 | 10/1964 | Dew et al. | 166/261 |
| 3,285,335 | 11/1966 | Reistle, Jr. | 166/303 X |
| 3,386,508 | 6/1968 | Bielstein et al. | 166/272 X |
| 3,954,140 | 5/1976 | Hendrick | 166/50 |
| 4,022,279 | 5/1977 | Driver | 166/303 X |
| 4,099,783 | 7/1978 | Verty et al. | 166/50 X |
| 4,160,481 | 7/1979 | Turk et al. | 166/272 |

FOREIGN PATENT DOCUMENTS

| | | | |
|---|---|---|---|
| 733808 | 5/1966 | Canada | 166/272 |
| 1163750 | 2/1964 | Fed. Rep. of Germany | 166/302 |
| 911889 | 11/1962 | United Kingdom | 166/263 |

OTHER PUBLICATIONS

Ranney, "The First Horizontal Oil Well", *The Petroleum Engineer*, Jun. 1939, pp. 25–30.

*Primary Examiner*—Stephen J. Novosad
*Assistant Examiner*—George A. Suchfield
*Attorney, Agent, or Firm*—Bard, Groves, Sroufe, Bishop & Berger

[57] ABSTRACT

Improved methods and apparatus are provided for recovering high viscosity oils from sub-surface earth formations. In particular, a large diameter shaft hole is employed and a plurality of substantially horizontal drill holes extend radially from the shaft hole into the formation. It is a feature of this invention to provide vertically spaced drill holes oriented to improve the recovery of the oil. Methods are provided for further enhancing oil recovery by coordinating the injected fluid with the location of injection within the formation.

14 Claims, 6 Drawing Figures

METHOD FOR RECOVERING HIGH VISCOSITY OILS

RELATED PATENT APPLICATIONS

This is a continuation of application Ser. No. 108,815, filed Dec. 31, 1979, now abandoned, which was a continuation-in-part of Ser. No. 940,390, filed Sept. 7, 1978, now U.S. Pat. No. 4,257,650.

BACKGROUND OF THE INVENTION

This invention relates to methods and apparatus for recovering high viscosity oil from sub-surface earth formations, and more particularly relates to improved methods and apparatus for recovering such oils by employing a large diameter shaft hole and a plurality of drill holes extending radially from the shaft hole.

Early disclosures relating to the recovery of petroleum substances by utilizing a large diameter shaft hole and a plurality of drill holes are provided in U.S. Pat. Nos. 1,520,737 and 1,634,235, and a paper published by Ranney in the *Petroleum Engineer* in 1939 entitled "The World's First Horizontal Hole". These publications propose the drilling of a large diameter shaft into an oil-bearing formation and then drilling radial drill holes into the formation. More recently, U.S. Pat. Nos. 4,020,901; 4,099,570; 4,099,783 and 4,160,481 provide improved systems for recovering petroleum substances employing large diameter shaft holes and radials. The above processes, however, suffer limitations relating to restrictions on the rate of introducing the injection fluid, and the overall efficiency of the oil recovery process according to the above techniques may be so poor that recovery of the oil is not economically feasible.

The publication and patents referred to above teach that steam or other heated fluids can be injected into horizontal drill holes or laterals extending from a large diameter shaft hole. The steam or other heated injection fluid is introduced via laterals into the formation in order to provide heat to the formation and thus reduce viscosity of the oil. The heated oil thereafter flows to recovery laterals, being assisted by gravity.

The above procedure is generally referred to as a "soak" operation, which should be distinguished from a "drive" operation. In a "soak" operation, the injected fluid is intended to lower the viscosity of the oil and thereby enable the oil to more freely flow toward recovery lines by gravitational forces. A soak operation may be enhanced by raising the pressure in the formation and assisting the recovery of oil by increasing the differential between the formation pressure and the pressure at the point of recovery.

It is also common practice to inject fluid into a conventional vertical well for the purpose of driving oil within a formation horizontally to be recovered by a distant vertical well. In this "drive" operation, injected fluid is intended to act as a vertical bank or wall in the formation and push or drive the oil horizontally toward the recovery well. Although the drive operation may be enhanced by injection either a heated fluid or a solvent to additionally lower the viscosity of the oil, the injected fluid is ideally acting as a piston head to move through the formation and drive the oil toward the point of recovery. Horizontal drive often results in viscous fingering and/or gravity override which are very detrimental to a horizontal drive operation. Horizontal drive operations are therefore generally concerned with the "critical velocity" of the injected fluid, so that the driving force does not break down as a result of viscous fingering or gravity override. Since the fluid injected in horizontal drive operations in preferably introduced at rates to keep the driving operation below the critical velocity, the recovery rate, and the corresponding economics of this operation, are often unacceptable. Both phenomena commonly referred to as viscous fingering and gravity override, as well as the differences between "soak" and "drive" operations, are more fully discussed in my co-pending application, Ser. No. 940,390, now U.S. Pat. No. 4,257,650.

It is also well-known to inject water via conventional vertical bore holes into the bottom of an oil-bearing formation, while producing oil from conventional vertical bore holes near the top of the formation. In this procedure, often referred to as conventional vertical flooding, the oil is displaced vertically upward by the injected water. By using conventional vertical bore holes terminating near the top of the formation and conventional vertical bore holes terminating near the bottom of the formation, it is also known that low viscosity oils can be collected by injecting a light hydrocarbon in the top of the formation while recovering the light oil from the vertical bore hole terminating at the bottom of the formation. In the latter procedure, the light oil is pushed downward by the lighter hydrocarbon. The recovery of oil utilizing conventional vertical wells and drive techniques are often poor, however, because a limited number of points of recovery are provided by the vertical wells.

These conventional techniques have several inherent problems. In order to properly "blanket" an area prior to establishing active horizontal driving displacement of the oil, the displacing fluid must be injected at a low rate. Also, if effective blanketing is to be achieved, the formation must have high permeability and the difference in density between the oil and the injected fluid should be high. If a good blanket of injecting fluid is not formed, or if a good blanket is formed but the displacing fluid is injected at too high a rate, viscous fingering can result. When this condition occurs, the injecting fluid no longer effectively displaces the oil, and the volumetric sweep efficiency of the operation falls off drastically.

In order to minimize the likelihood of viscous fingering when utilizing the prior art techniques, the injecting fluid is often introduced into the formation at low injection rates, e.g., 400 barrels of fluid per day per well. Optimum steam injection rates with vertical wells are more fully discussed in an article by Messrs. Bursell and Pittman, appearing in the *Journal of Petroleum Technology,* August, 1975, beginning on page 997. Low injection rates, of course, generally result in low production rates, which significantly increases the cost of production.

The problems and disadvantages of the prior art are overcome with the present invention. Novel methods in apparatus are hereinafter provided for recovering high viscosity oils from sub-surface formations, wherein a greater percentage of the oil can be recovered from the formation and can be recovered in a more efficient manner.

SUMMARY OF THE INVENTION

In one embodiment of this invention, a vertical mine shaft of sufficient diameter to accommodate personnel and equipment is bored to and through a formation containing a high viscosity oil. The vertical shaft is enlarged near the top of the formation and near the bottom of the formation forming chambers to provide increased space for men and equipment. Substantially horizontal drill holes or laterals are thereafter bored radially into the formation. The numbering and spacing of these laterals will be discussed in detail below. For the present, it is significant that one group of laterals is provided near the top of the formation, and another group of laterals is provided near the bottom of the formation. Each group or set of boreholes or laterals effectively blankets a particular portion of the formation, and the configuration of each blanket may be rectangular. Thereafter, drill holes are bored into the face of the formation and radially about the chamber, through which a suitable fluid is thereafter injected into the formation by way of a conduit leading to the surface.

Using the above-described apparatus with one set of laterals near the top of a formation and another set at the bottom of a formation, oil may be recovered by either (a) introducing an injected fluid into the bottom set of laterals while recovering oil from the top set of laterals, or (b) introducing an injected fluid into the top set of laterals while recovering oil from the bottom set of laterals.

The instant invention preferably utilizes a plurality of substantially horizontally laterals which are drilled in the formation for recovery of high viscosity oil through "drive" techniques, while the prior art attempts to improve oil recovery by using boreholes or laterals within the formation and various "soak" techniques. In the present invention, the driving force of the injected fluid is substantially vertical: vertical upward drive toward the top set of laterals, or vertical downward drive toward the bottom set of laterals. The advantage of driving vertically rather than horizontally, as taught by conventional oil recovery techniques, is that the injected fluid may be introduced at a much higher rate because the likelihood of viscous fingering is substantially reduced and detrimental gravity override is eliminated. A fluid may therefore be injected according to the present techniques at rates equivalent to the maximum output of most commercial generators, without regard to the concept of critical velocity, fingering, or gravity override.

In conventional oil wells, it is often quite difficult to establish a blanket of injected fluid, although the fluid is injected at various points in the plane of the blanket. According to the present invention, the blanket of injected fluid may be more easily established since the fluid is not injected at points in the blanket, but rather is injected along entire lines lying within the blanket. These lines effectively provide a multitudinous number of points of injection so that the blanket for the drive operation is more easily established.

As prevously mentioned, the apparatus described may be utilized for vertical upward drive or vertical downward drive. This offers a distinct advantage over the prior art since the injected fluid can be selected for either upward or downward drive depending on the density of the oil in the formation, the desirabilty of using a miscible or an immiscible injected fluid, the availability of the injected fluid, and the particular characteristics of the formation. For instance, if the oil in the formation is a heavy crude oil, e.g. 14° API, and a relatively heavy injected fluid is available, e.g. carbon disulfide, vertical upward drive of the oil is feasible. Thus, carbon disulfide, may be injected in the bottom set of laterals, and since the injected fluid is heavier than the oil, it would not tend to rise naturally in the formation. A blanket of injected fluid may be thereby easily established in the bottom of the formation. As the injection of carbon disulfide continues, the injected fluid drives oil upward in the formation toward the top set of laterals. Fluid may continue to be injected in the bottom set of laterals while oil is recovered from the top set of laterals, until the injected fluid is effectively driven through the entire formation.

If, on the other hand, the formation pressure is high and heated water is readily available as an injected fluid, downward vertical drive may be desirable. heated water at 500° F. is less dense than 14° API oil. Thus, heated water may be injected in the top set of laterals serving to drive the oil downward for recovery by the bottom set of laterals. In this manner, a blanket of injected fluid is established in the upper portion of the formation, and the oil is driven downward by the continued injection of fluid.

The particular spacing and arrangement of drill holes will, of course, depend upon the size and lithology of the formation of interest, but it is a feature of the invention to provide approximately eight different radially extending drill holes for each shaft hole, and to further extend such drill holes to a location adjacent the ends of similar radicals extending from an adjacent vertical shaft hole. As will hereinafter be explained in detail, each group of radial drill holes will then define a rectangular pattern within the field, and thus the field may be effectively "covered" with a blanket of such rectangular patterns.

The bore holes or radicals may extend from the large diameter shaft hole in a generally horizontal direction. Some of the radials, however, may be positioned at a slight upward angle, e.g., 3°–7°, so that gravity may assist the flow of oil within the lateral. Also, some formations have generally horizontal barrier zones which are impermeable to fluid flow. Relatively thin shale deposits are one example of these impermeable barrier zones. When such zones exist, the bore holes or laterals may be drilled at a greater upward angle, e.g., 10°–18° upward from the horizontal, so that the bore holes would pass through one or more of these barrier zones. Thus, the recovery of oil and the efficiency of the operation will be increased since oil can be recovered by soak or drive techniques which would have previously remained within the formation because of the presence of the impermeable barrier zones.

It is within the concept of the present invention to locate the radials adjacent the lower limit of the formation, whereby the fluid injected therefrom will also tend to rise as well as travel laterally through the formation, and also to provide additional pluralities of such radial drill holes at other higher locations within thicker formations. Furthermore, it is within the concept of this invention to inject fluid through only a portion of the radials, while also recovering oil from one or more of the other radials extending from the same shaft hole.

The invention is suitable for recovering oil from subsurface formations, and is particularly suitable for recovering high viscosity oils. High viscosity oils are generally inclusive of both medium gravity oils having an API range of 20° to 25°, and heavy crude oils having an API range of 20° or less.

A particular feature of this invention is to provide methods and apparatus that result in increased production rates for recovering high viscosity oil from subsurface earth formations.

It is another feature of this invention to provide methods and apparatus for driving oil within a subsurface earth formation vertically toward recovery laterals extending radially from a large diameter shaft hole.

It is a further feature of this invention to provide methods and apparatus that will increase the overall efficiency of recovering high viscosity oil from a subsurface earth formation by utilizing vertical drive techniques.

It is an additional feature of this invention to provide apparatus for recovering oil from a subsurface earth formation, comprising a shaft hole extending from the surface to said subsurface earth formation, a first plurality of boreholes extending radially from said shaft hole into said formation at a first elevation, a second plurality of boreholes extending into said formation at a second elevation, and injection means introducing a fluid through said second plurality of said boreholes and into said formation for driving said oil vertically for recovery by said first plurality of boreholes.

It is a further feature of this invention to provide a method of recovering oil from a subsurface earth formation, comprising establishing a shaft hole extending from the surface of the earth to said subsurface earth formation, drilling a first plurality of boreholes radially from said shaft hole into said formation at a first elevation, drilling a second plurality of boreholes into said formation at a second elevation, and injecting a driving fluid into said second plurality of boreholes and into said formation for driving said oil vertically for recovery by said first plurality of boreholes.

These and other features and advantages of the present invention will become apparent from the following detailed description, wherein reference is made to the figures in the accompanying drawings.

IN THE DRAWINGS

DETAILED DESCRIPTION

Figure 1:
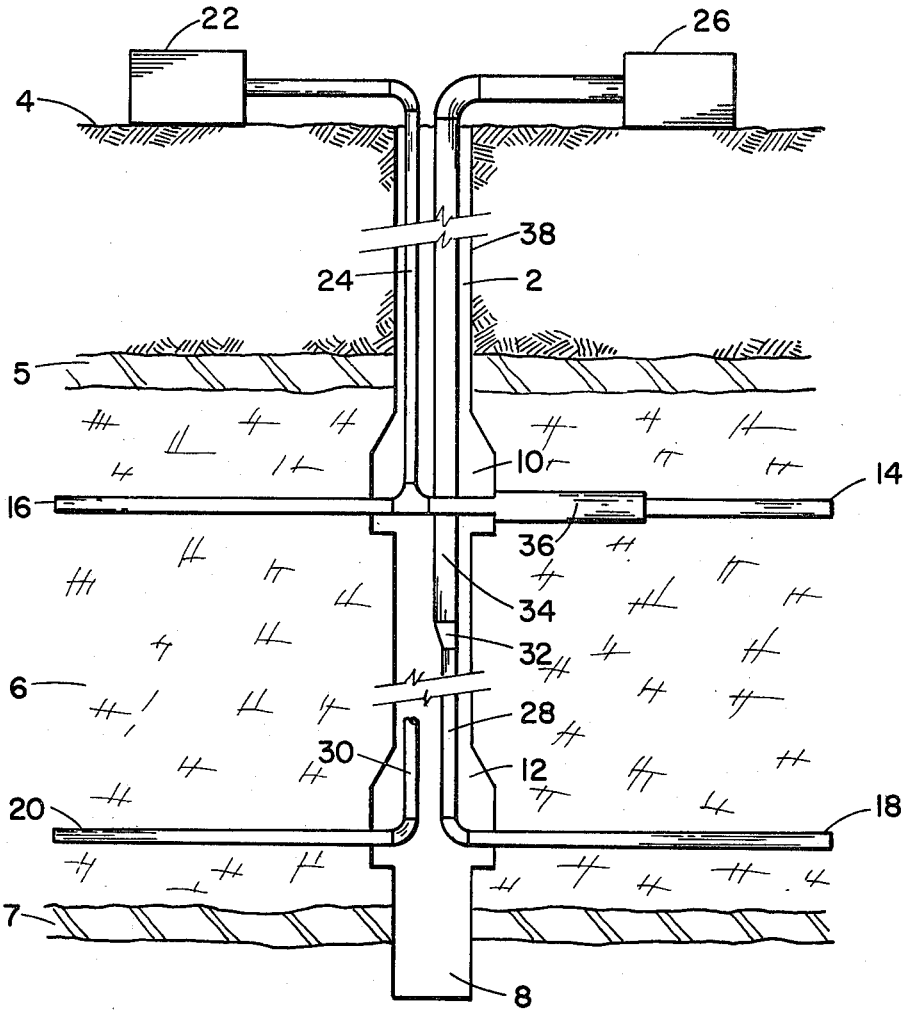
FIG. 1 is a simplified pictorial representation, partly in cross section, of an exemplary installation for recovering oil from a subsurface earth formation according to the present invention.

In FIG. 1, there may be seen a pictorial representation of an oil recovery system embodying the concepts of the present invention. In particular, the apparatus depicted in FIG. 1 may be utilized for recovering high viscosity oil from subsurface earth formations. A substantially vertical mine shaft 2 is drilled or bored from the surface 4 to the oil bearing formation 6. The oil bearing formation 6 may typically be hundreds of feet below the surface 4, and is shown to be bounded by an upper layer 5 and a lower layer 7 of shale deposits, which are generally impregnable to fluid flow. As seen in FIG. 1, the mine shaft 2 is drilled through the oil bearing formation 6, and terminates at a sump hole 8.

The shaft 2 is expanded near the top portion of the formation to form an upper work chamber 10, and is expanded at the bottom portion of the formation to form a lower work chamber 12. A plurality of upper laterals 14 and 16 may be drilled into the formation 6 from the upper work chamber; a plurality of lower laterals 18 and 20 may likewise be drilled into the formation from the lower work chamber 12.

A steam generator 22 at the surface floor provides injection fluid to the upper laterals 14 and 16 by a steam line 24. If desired, a plurality of steam lines 24 may be provided, so that the injected fluid to each upper lateral may be separately controlled at the surface by conventional valving techniques. The lower laterals 18 and 20 may serve as recovery lines for oil, which is collected in recovery tank 26. Each of the lower laterals 18 and 20 may be connected to individual recovery lines 28 and 30 which may terminate at the recovery tank 26, or the recovery lines 28 and 30 may join at a subsurface manifold 32 so that oil from the various lower laterals 18 and 20 flows to the recovery tank 26 by a central recovery line 34.

Referring again to FIG. 1, it may be seen that a portion of the radial or lateral 14 extending from the wall of the upper work chamber 10 may be suitably provided with a casing 36, with a perforated portion of the lateral 14 thereafter extending from the casing 36. The walls of the shaft 2 may be conveniently sealed with sections of bolted or welded steel plates to form a casing 38, or may be lined with an appropriate material such as gunite, to prevent caving or other collapse of the walls of the shaft 2. The diameter of the shaft 2 is preferably of a size sufficient to accommodate the passage of men and equipment from the surface 4 to the interior of the work chambers 10 and 12. The mine shaft 2 and each of the work chambers 10 and 12 may be constructed in the manner further described in U.S. Pat. No. 4,160,481.

In the embodiment of this invention illustrated in FIG. 1, fluid is injected into the formation via radial drill holes or laterals 14 and 16 which lie entirely within the formation 6. If the injected fluid is heated water or steam, heat loss by way of the steel casing 38 therein is not significant since the heat merely transfers to the formation. On the other hand, it is desirable for the injected fluid to enter the formation at a distance from the shaft 2 or work chamber 10, so that the fluid will tend to move outwardly therefrom instead of bypassing back into the chamber 10. Furthermore, it may be preferable to insert pre-perforated pipe or casing into the radial drill holes, rather than to perforate the casing in a conventional manner after it has been inserted. The upper laterals may contain the casing 36, but the casing is not necessary according to the present invention. Thus, although the casing 36 is only shown for the upper lateral 14, it is within the concept of my invention that the casing be employed with all, some, or none of the injection laterals.

Figure 2:
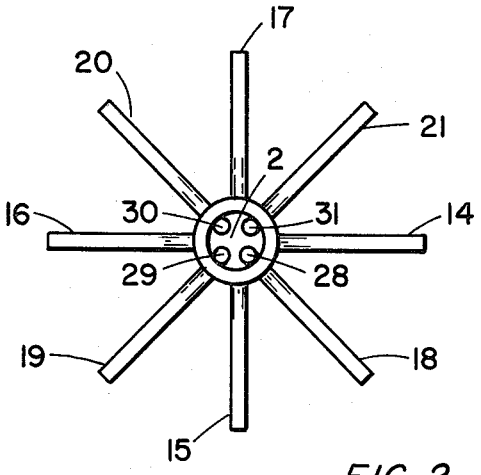
FIG. 2 is a cross-sectional representation of a portion of the apparatus depicted in FIG. 1.

Referring now to FIG. 2, there is illustrated a cross-sectional view of the laterals shown in FIG. 1. In FIG. 2, four upper laterals radiate from the shaft 2 at 90° intervals, and are denoted as 14, 15, 16 and 17. Four lower laterals are also spaced at 90° intervals, and the lower laterals 18, 19, 20, and 21 are shown connected to their respective vertical recovery lines 28, 29, 30, and 31.

Both the upper set of laterals and the lower set of laterals depicted in FIGS. 1 and 2 lie in substantially horizontal planes. As explained in further detail below, the upper set of laterals, in combination with an injected fluid, form a blanket of injected fluid which act as the driving force for the recovery process. Typically, the laterals will radiate from the shaft 2 to enable a substantially horizontal blanket to be established having an area of 25 acres. In FIG. 2, the pattern of the blanket formed by the injection radials 14, 15, 16, and 17 is circular. Other configurations are possible, and the particular configuration of the blanket formed by the injection laterals will depend, in part, on the characteristics of the formation, the viscosity of the oil in the formation, the injected fluid, and the possible use of injection laterals in combination with conventional wells. For instance, the configuration of the injection laterals may form a rectangular blanket, as shown in my co-pending patent application, which is hereby incorporated by reference in its entirety. The length of the laterals will depend on their relative position to one another, since the injection laterals preferably function to form a uniform substantially horizontal blanket in a portion of formation 6. Further, the diameters of the laterals will depend primarily upon the type of matrix composing the formation 6, as well as the viscosity of the oil sought to be recovered therefrom.

Figure 3:
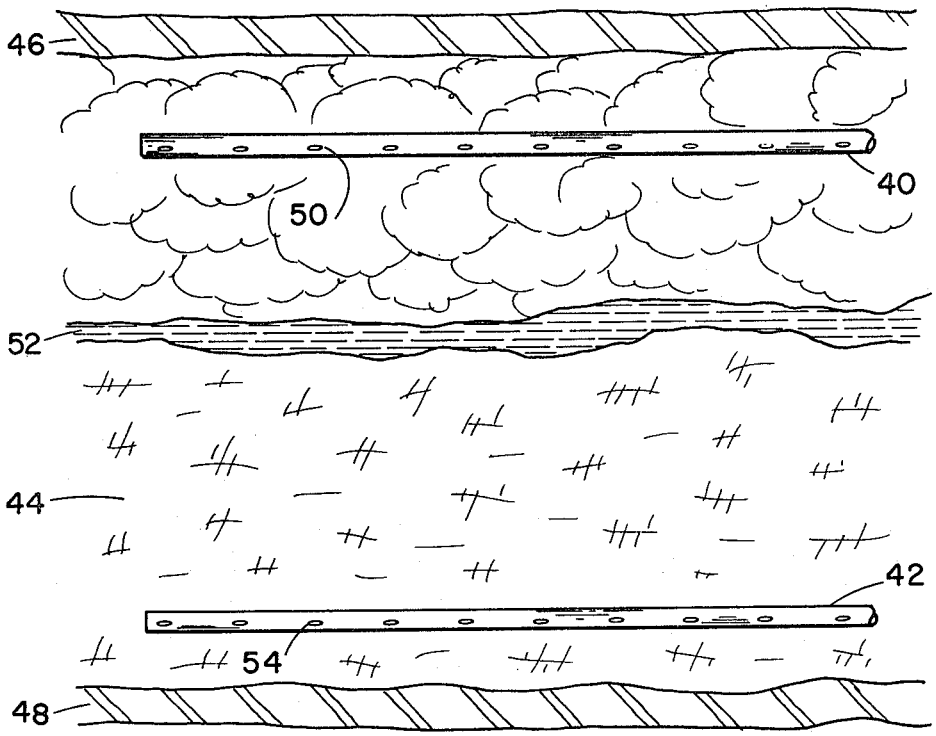
FIG. 3 is a simplified pictorial representation, partly in cross section, of a portion of the apparatus depicted in FIG. 1.

FIG. 3 illustrates a portion of the apparatus generally depicted in FIG. 1. A tubular member 40 is typically inserted into any of the boreholes described, such as the laterals 14, 15, 16, and 17 in FIG. 2. Likewise, a tubular member 42 may be inserted into the laterals 18, 19, 20, and 21. The oil bearing formation 44 is bounded on the top by a layer of shale or other rock 46, and on the bottom by a similar impregnable layer of shale or other rock 48. The layers 46 and 48 are typical of any number of materials which often exist on the upper and lower portions of an oil bearing formation. Generally, these impregnable layers line a substantially horizontal plane, although perhaps not as uniform as the layers depicted.

As previously stated, it is preferable according to the present invention that the upper tubular member 40 be placed near the upper portion of the formation, and that the lower tubular member 42 be near the bottom portion of the formation. The exact spacing of the upper and lower laterals will possibly depend on the configuration of the layers 46 and 48. If these layers are uniform and substantially horizontal within the area of the recovery operation, the laterals may be drilled very close to the layers. If the layers are irregular in configuration, the upper laterals may be drilled in the upper fifth of the formation, and the lower laterals in the lower fifth of the formation. For example, if the formation 44 is approximately 60 feet thick and substantially uniform in configuration, the upper tubular member 40 is preferably 1 to 5 feet from the bottom of the top layer 46, and the lower tubular member 42 is preferably 1 to 5 feet above the top of the bottom layer 48.

A simplified method of operation according to the present invention will now be described by reference to FIGS. 1, 2, and 3. For the present, it will be assumed that steam has been selected as the injection fluid, and that both steam and water at the temperature and pressure within the formation are less dense than the oil in the formation.

Steam from the generator 22 may be injected into upper laterals 14, 15, 16, and 17 by a plurality of steam lines 24. The steam may enter the formation 44 through a series of perforations in the upper tubular members, such as the perforations 50 in the tubular member 40. The perforations 50 may be formed along the entire length of the tubular member 40, and are preferably formed along at least a substantial portion of the length of the tubular members.

Heat from the injected steam will decrease the viscosity of the oil in the formation adjacent the tubular member 40. As the formation 44 is heated, condensate may be formed which will be more dense than the steam, but less dense than the oil in the formation. The steam from the tubular member 40 will, in combination with the steam simultaneously injected in the other upper laterals, produce a blanket of steam generally in the plane of the upper laterals.

Continued injection of steam into the upper laterals will cause a pressure increase in the top of the formation 44. This pressure increase will drive the oil in the formation downward toward the lower tubular member 42. Also, the condensate from the injected steam may serve as a face for the driving force. In other words, the increase in pressure above the condensate layer will force the condensate layer downward, thus driving the oil downward from the formation.

As the steam is injected in the upper tubular member 40, oil will be simulataneously recovered through perforations 54 along a substantial portion of the length of the lower tubular member 42. Referring to FIG. 2, steam injected into the upper laterals 14, 15, 16, and 17 will drive the oil downward for recovery by the lower laterals 18, 19, 20, and 21. In this manner, the oil from the formation 44 may be efficiently recovered by the downward drive of the injection fluid.

As stated above, the present invention may be effectively employed by utilizing a driving fluid and driving the oil vertically toward recovery laterals. In a vertical driving technique, the pressure gradient within the formation may be altered by the injected fluid to force the oil toward the recovery lines. Because of the weight of the oil in the formation, the pressure near the upper section of the formation will generally be less than the pressure in the lower portion of the formation. By way of illustration and referring to FIG. 1, if the formation 6 were 60 feet thick and the pressure at the top of the formation just below the layer 5 was 15 psi, the pressure near the bottom of the formation above the layer 7 may typically be 40 psi because of the pressure gradient of the oil in the formation 6.

According to the vertical steam drive techniques discussed herein, drawing the oil from the recovery lines and injecting a fluid into the injection lines will produce a pressure differential sufficient to force or drive the oil vertically. Preferably, a pressure differential of 100 psi or more is achieved during the driving process between the pressure at the place of injection and the pressure at the place of recovery within the formation. The preferred pressure differential will vary depending on the specific characteristics of the oil and the formation, and typically a pressure differential of 200 psi to 400 psi will be desired. The maximum pressure at the place of injection is generally limited for safety reasons to 1 psig per foot of overburden. For instance, if steam is injected into the laterals 14, 15, 16 and 17 which are 400 feet below the surface 4, it may be desired to limit the pressure provided in the upper portion of the formation 6 to 400 psi.

As previously mentioned, vertical drive may be properly utilized without concern for gravity override, even with injection rates far exceeding the injection rate employed in conventional horizontal drive. In the embodiment described above, the density contrast between the oil and the injected fluid is deliberately utilized during the driving operation to increase the efficiency of the recovery processes, while the same density contrast may result in gravity override in horizontal drive operations which is detrimental to the efficiency of horizontal drive recovery processes. Also, since the oil is being driven vertically downward, the likelihood of viscous fingering during the driving operation is substantially eliminated since (a) a uniform blanket of driving fluid is initially formed, (b) the condensate layer 52 acts as a face for driving the oil from the formation, and (c) the oil is being driven vertically downward, and the injected fluid will not tend to pierce through the formation 44 because the injected fluid is less dense than the oil below the injected fluid. Further, as explained below, viscous fingering prior to the driving operation increases the efficiency of the recovery process according to the present invention, rather than being detrimental to the recovery efficiency as in horizontal drive techniques.

Steam may be continually injected into the upper tubular member 40 until condensate or steam has been recovered from the lower tubular member 42. At this point, further injection of steam may be economical, since little if any further oil will be recovered from the lower tubular member 42. If the vertical recovery lines 28 and 30 are used to connect each lateral to the recovery tank 26, it is possible to monitor the fluid being recovered at the surface 4 from each lower lateral. In this manner, it may be desirable to discontinue the injection of steam into the upper laterals which are adjacent the lower laterals in which steam or condensate is being recovered, while continuing to inject steam into the other upper laterals as long as oil is being produced from their respective adjacent lower laterals. If the recovered oil is either being forwarded to a subsurface manifold 32 or is being taken from a common sump hole 8, the monitoring of the recovered fluid from the individual lower laterals may be accomplished before that fluid is intermingled with fluid from the other lower laterals. Use of the common sump hole 8 for recovering laterals is more fully described in my co-pending application Ser. No. 940,390.

Referring again to FIG. 2, the following is an example of the monitoring procedure described above. Steam may be initailly injected into the four laterals 14, 15, 16, and 17, forming a substantially horizontal blanket of steam in the plane of the upper laterals. Continued injection of the steam will drive the oil in the formation to the lower laterals. Once steam or condensate has been recovered from one of the lower laterals, e.g., lateral 21, steam may be continued to be injected into the upper laterals 15 and 16, while steam is not injected into the upper laterals 14 and 17. Thus, oil recovery would continue from the lower laterals 18, 19, and 20, but oil recovery from the lower lateral 21 would be effectively discontinued.

An alternative procedure that may be used when steam or condensate is recovered in one of the plurality of lower laterals is to inject cold water into the lower lateral while continuing steam injection into the upper laterals. Referring to the example described immediately above, if water or condensate is being recovered from the lower lateral 21, cold water may be injected into lower lateral 21 while continuing to inject steam in either upper laterals 15 and 16 or all the upper laterals 14, 15, 16, and 17. The introduction of the cold water into the lower lateral 21 effectively terminates the recovery of any fluid from the lateral 21, thus the steam injected into the formation would be effectively used to produce oil from the laterals 18, 19, and 20.

One of the advantages of the plurality of upper laterals 14, 15, 16, and 17 is that a blanket can be easily and rapidly established in the formation which will enhance the driving efficiency of the injected fluid. The rapid establishment of a blanket in the formation will increase the thermal efficiency of the recovery process since less heat and injection fluid will be lost to adjacent beds or escape from the formation entirely. Conventional vertical injection wells do not result in the rapid and efficient establishment of a blanket, since the fluid is injected at points within the plane of the blanket. According to the present invention, the laterals lie within the plane of the blanket to be established, and thus lines of injection are provided rather than mere points of injection. The particular number of laterals used will depend on a variety of factors. It is within the concept of the present invention that a plurality of laterals radiate from the mine shaft at at least two vertical elevations. The embodiment illustrated in FIG. 2 shows four upper laterals and four lower laterals, but any number of upper and lower laterals may be used. For instance, eight equally spaced upper laterals could be used in conjunction with eight equally spaced lower laterals. The efficiency of the recovery process would be generally enhanced by the increased number of laterals, but the increased number of laterals also results in increased drilling and equipment costs.

It is preferable that equal numbers of upper laterals and lower laterals be provided, and that the individual upper laterals and individual lower laterals be equally spaced from each other. Thus, as shown in FIG. 2, each of the upper laterals is 90° apart from adjacent upper laterals, and the lower laterals are 90° apart from adjacent lower laterals. In addition, it is preferable that lower laterals be spaced between upper laterals, as compared to having the lower laterals directly below the upper laterals. As shown in FIG. 2, each of the lower laterals is 45° apart in the horizontal direction from its adjacent upper laterals; if eight upper laterals were used in conjunction with eight lower laterals, each lower lateral would preferably be offset from its adjacent upper lateral by 22.5°. One advantage in offsetting the lower laterals from the upper laterals is that a longer path is thereby provided between the injection laterals and the recovery laterals. Thus, the injection fluid tends to spread out evenly through the formation and increase the sweep efficiency of the recovery process. If the upper laterals were to be placed directly above the lower laterals, there is less likelihood that the oil near the bottom of the formation and between the lower laterals would be recovered.

Figure 5:
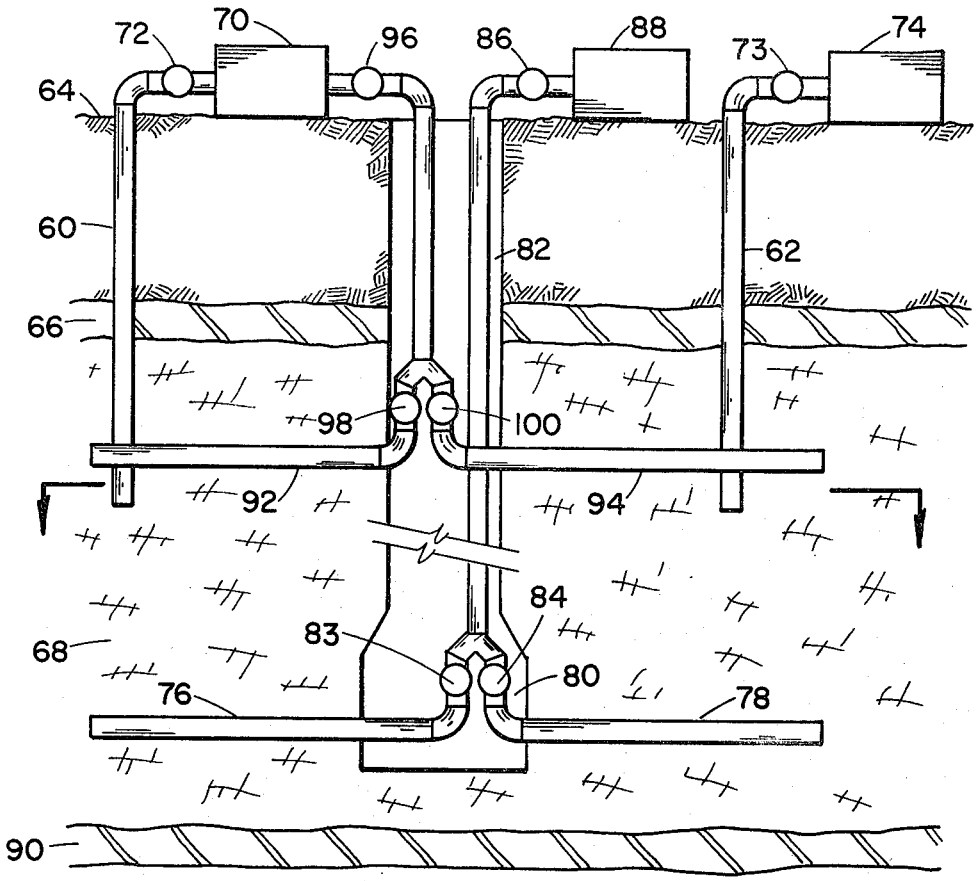
FIG. 5 is a simplified pictorial representation, partly in cross section, of another form of an exemplary installation according to the present invention.

As previously described, the use of upper and lower laterals within a formation enables a blanket to be easily formed for the driving process. It is possible to use conventional vertical injection wells instead of the injection laterals, although the blanket of driving fluid may not be established as readily as if horizontal boreholes or laterals were used for the injectors. Referring to FIG. 5, there is illustrated another form of my invention which employs the use of conventional vertical wells 60 and 62. It will be seen that these conventional vertical wells 60 and 62 are drilled from the surface 64 through the top rock layer 66 and terminate in the upper portion of the formation 68. Fluid may be injected into the vertical wells from a common generator, or separate generators 70 and 74 may be employed for each vertical well. Valves 72 and 73 may be used to control the flow of fluid from the generators to the formation.

The laterals 76 and 78 extend radially from the work chamber 80 in the lower portion of the mine shaft 82. The lower set of laterals preferably "blanket" a portion of the formation, as previously described. Valves 83, 84 and 86 may be used to control the recovery of oil from the laterals to the recovery tank 88. In FIG. 5, both the laterals 76 and 78, and the work chamber 80 are entirely within the lower portion of the formation 88, and lie above the rock layer 90.

It is also within the concept of my invention to utilize conventional vertical boreholes in combination with both upper and lower laterals, if desired, to assist the formation of a blanket and the driving process. Thus, in FIG. 5 there is illustrated vertical injection wells 60 and 62 plus horizontal laterals 92 and 94. By controlling valves 96, 98 and 100, the injection of fluid from the generator 70 to each of the horizontal injection laterals 92 and 94 may be controlled.

Figure 6:
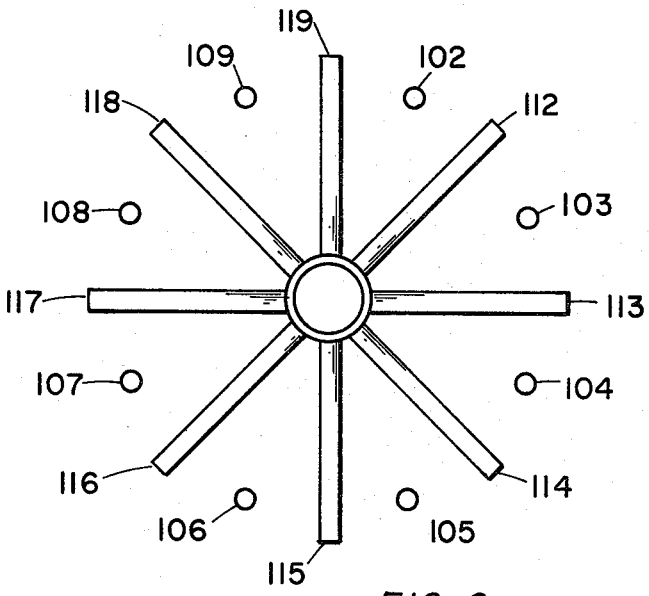
FIG. 6 is a cross-sectional representation of a portion of the apparatus depicted in FIG. 5.

Referring now to FIG. 6, there is shown a cross-sectional view of a portion of the apparatus depicted in FIG. 5. The vertical injection wells are designed as 102, 103, 104, 105, 106, 107, 108 and 109, with wells 103 and 108 corresponding to the wells 60 and 62 shown in FIG. 5. The horizontal recovery laterals form a generally rectangular blanket, and are designated as laterals 112, 113, 114, 115, 116, 117, 118 and 119, with laterals 113 and 117 corresponding to laterals 76 and 78 in FIG. 5. It will be seen that the vertical wells may be spaced between the horizontal laterals, and that the injection wells are spaced geographically to cover the area to be blanketed. If desired, other injection wells may be spaced inwardly to the vertical mine shaft from the injection wells shown in FIG. 6.

If horizontal injection laterals are utilized, it is anticipated that vertical injection wells would generally not be necessary. On the other hand, if vertical injection wells are utilized, it generally may not be necessary to drill horizontal injection laterals. However, it is possible to use both vertical and horizontal injections, and this may be desirable if only a relatively few number of injection laterals are utilized.

To assist in establishing a horizontal blanket if vertical injectors are used in combination with recovery laterals, fluid may be initially injected into a portion of the vertical boreholes while oil is recovered from the remaining vertical boreholes. Thus, fluid may initially be inserted into the odd-numbered vertical wells, and the oil may be driven horizontally and recovered by the adjacent even-numbered vertical boreholes until the injection fluid is recovered in the adjacent even-numbered vertical boreholes. At this point, a horizontal blanket of injection fluid is established, and fluid may be injected in all the vertical boreholes 102 through 109 to drive the oil downward for recovery by the lower laterals 112 through 119. In this embodiment, the vertical boreholes are preferably spaced between the injection laterals and toward the periphery of the blanketed zone to increase the efficiency of the recovery operation. As previously described, it is within the concept of this invention to drive vertically upward or vertically downward, and the conventional vertical boreholes herein described may terminate near the top of the formation if downward drive is desired, or may terminate near the bottom of the formation if upward drive is desired.

It is within the concept of this invention to employ a plurality of substantially horizontal laterals and inject fluid to drive the oil in the formation vertically toward recovery laterals. Oil may be driven vertically upward or downward, and thus the upper laterals and lower laterals may function either as injection laterals or recovery laterals. For instance, steam may be effectively used in many operations wherein the steam is injected into the upper laterals, since both the steam and the condensate at the temperature and pressure within the formation may be less dense than the oil. However, some miscible fluids which are more dense than the oil in the formation can also be effectively used as a driving fluid. If the injected fluid chosen, e.g., carbon disulfide, is more dense than the oil, it may be advantageous to inject the fluid in the lower laterals 18, 19, 20, and 21 while recovering oil from the upper laterals 14, 15, 16, and 17. In this case, the heavier injected fluid would easily and rapidly form a blanket in the lower portion of a formation, and continued injection would drive the oil upward toward the recovery laterals. Also, neither gravity override or viscous fingering is a problem in this case during the driving operation, since the heavier injected fluid is below the oil to be displaced.

It may therefore be seen that the present invention is applicable with both miscible and immiscible injection fluids. Also, it is within the concept of my invention to inject a liquid lighter than the oil in a formation into the upper laterals, and thereafter to drive the oil downward toward the lower laterals by injecting a gas or a gas/liquid mixture in the upper laterals as the driving force. More particularly, a solvent less dense than the oil may be injected into the upper laterals to form a blanket of fluid to act as the face of the driving force. Successively lighter slugs of fluid, each slug having a lower density than the previous slug, may thereafter be injected into the formation. Finally, a gas may be injected. The injecting slugs of fluid and gas produce a driving force, and the solvent first injected acts as the face of the driving force. This technique, which may be referred to as graded miscible displacement, may be highly effective, permit much higher injection rates, and yield higher production rates than possible according to the prior art.

Figure 4:
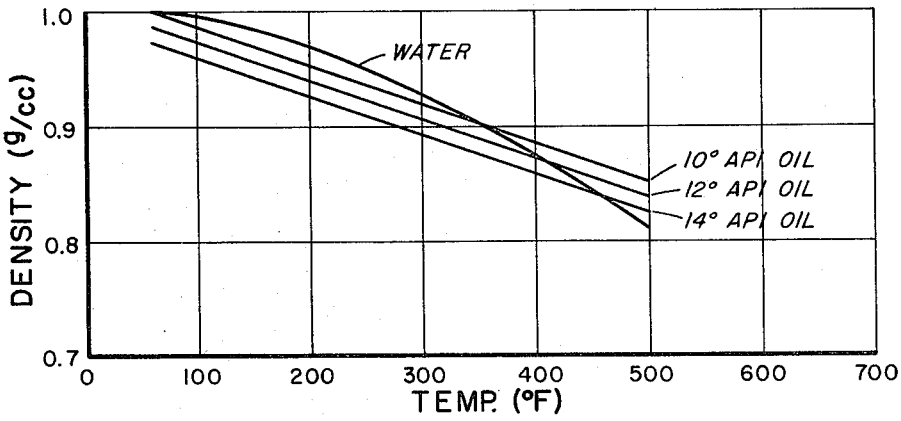
FIG. 4 is a graph illustrative of the variations in specific gravity for fluids, and is referred to in the description to assist in illustrating the concepts of the present invention.

The density of the injection fluid may vary with temperature changes to a different extent than the oil in the formation. It is possible, therefore, to inject a particular fluid in the top laterals as a driving force when that fluid is lighter than the oil, and to inject the same fluid in the lower laterals as a driving force when the fluid is heavier than the oil in the formation. Referring now to FIG. 4, there is depicted a chart which illustrates the approximate density of the water, 10° API oil, 12° API oil, and 14° API oil as a function of temperature. It will be noted that at 100° F., water is denser than 12° API oil, but that at 500° F., 12° API oil is denser than water.

The principle of different density changes for fluids can be fully utilized according to the present invention. For example, high temperature steam can be injected into the upper laterals, and 12° API oil can be recovered by the lower laterals. At the pressure within the formation, the condensate from the high temperature steam may form a layer of water at 500° F. In this case, both the steam and the condensate are lighter than the oil, and can be efficiently used to drive the oil downward. After steam or condensate has been recovered from one of the lower laterals, the injection of steam may be continued in the upper laterals that are not adjacent the lower lateral from which the condensate was recovered, as previously described. (Alternatively, steam may be injected in all the upper laterals while cold water is injected in the lower lateral from which condensate or steam has been recovered). If the formation were at a relatively shallow depth and therefore correspondingly lower formation pressures existed, it is within the concept of my invention to inject superheated steam to achieve the high temperature desired to maximize the efficiency of the recovery process.

After the downward steam drive has been completed, the driving process may be reversed and cold water may be injected in the lower laterals while oil is recovered from the upper laterals. From the graph in FIG. 4, it may be seen that at a temperature of 100° F., water is more dense than 12° API oil, and thus the injection of water will now drive some of the remaining oil in the formation upward toward the upper laterals. Thus, during both the vertically upward driving stage and the vertically downward driving stage, the density of the injected fluid enables an effective blanket to be established, and the likelihood of viscous fingering is substantially eliminated.

Although driving vertically in one direction according to the present invention will effectively sweep the formation, it is understood that the oil recovery process will not be 100% effective. Driving in both directions, i.e., driving downward and thereafter driving upward, will increase the percent of oil recovered. This increased recovery is due, in part, to the fact that formations are not completely homogeneous, and thus driving in the reverse direction will cause the driving fluid to invade some areas that may have been sheltered from the forward driving fluid. Also, the injection of cold water in the lower laterals, as described above, may cause some water to flash to steam because of the residual heat in the formation, and the steam may lower the viscosity of some remaining oil to enhance the effectiveness of the upward driving process.

In the methods described above, oil recovery is based on a vertical drive process, which may be simplictically described as injecting the fluid in one set of boreholes while recovering oil from another set of laterals. It is within the concept of my invention, however, to improve the efficiency of the vertical driving process by providing for a limited soak cycle for each of the sets of laterals. For instance, if a vertical downward drive of the oil is to be achieved, it may be initially desirable to inject steam in the lower laterals to soak the formation directly adjacent the lower laterals and thus improve the subsequent driving process. Also, the upper laterals may be thereafter injected with steam to soak the formation adjacent the upper laterals and therefore enhance the uniformity of the driving blanket. After the lower laterals have been opened and oil begins to flow in the lower laterals, steam may thereafter be injected in the upper laterals to drive the oil toward the lower laterals.

Soaking the formation about the upper and lower laterals prior to establishing the driving process, as described above, may be beneficial in most applications. If a high viscosity oil is to be efficiently driven, it may be desirable, if not essential, to establish a flow path between the point of injection and the point of recovery prior to the driving cycle. The heavy oil in many formations has such a high viscosity that it is very difficult to displace the oil by an injection fluid supplied from commercial generators.

If steam is to be used as the injection fluid in the application depicted in FIG. 1, the efficiency of the downward driving process may be substantially increased by first injecting steam in the lower set of laterals 18, 19, 20 and 21. As the lower portion of the formation 6 is being soaked, viscous fingering and gravity override will readily occur since the injected fluid is lighter than the oil, and is being introduced in the lower portion of the formation. As viscous fingering and gravity override occur, heated communication paths will be established between the lower set of laterals and the upper set of laterals. Thus, the formation may be subjected to repeated steam soak cycles from steam supplied through the lower set of laterals, wherein steam is injected into the lower laterals, the laterals are stopped off or shut in, and the laterals are opened for recovery of oil as a result of the soaking process.

When the repeated soaking from the lower laterals results in steam fingering to the top of the formation 6, the soaking process may discontinued and steam thereafter injected into the upper set of laterals 14, 15, 16 and 17 for driving the oil downward while recovering oil from the lower set of laterals. The steam soak cycle therefore results in communication paths between the injection locations and the production locations which may have a greater area than that commonly associated with horizontal driving techniques. For instance, when conventional horizontal drive between vertical wells is utilized in a formation 60 feet thick, the area or face of the driving formation is typically approximately 12,500 square feet per acre. If vertical drive is practiced between horizontal laterals according to the present invention, the area or face of the driving front increases to approximately 43,000 square feet per acre. Thus, if the same injection rate per area of driving front is utilized, fluid is injected at approximately 3.5 times the rate as in conventional horizontal drive. Moreover, since the oil is being driven vertically rather than horizontally, the injection rate per area of the driving front may be substantially increased since viscous fingering is substantially eliminated during the driving operation.

The larger driving face area, therefore, enables more driving fluid to be injected into the formation while maintaining a relatively low, stable driving velocity across the formation. Also, as previously mentioned, the driving velocity may be substantially increased when compared to horizontal drive since vertical driving minimizes the likelihood of viscous fingering. Further, the fluid may be injected at higher pressures and at higher rates than realized in the prior art, which improves the efficiency of the recovery process. For instance, steam which may have been injected at 25% quality in horizontal drive operations may effectively be injected at the higher rates and with greater steam quality, e.g., 80%, than in the prior art. Also, as previously mentioned, superheated steam may be used as the injection fluid.

Although this invention has principally been described with steam or water as the injection fluid, both heated and unheated fluid may be used as a driving force within the concept of my invention. For example, water, solvents, gas oil, distillate, LPG, and naptha, or a combination of liquids and gases may be utilized as the driving fluid according to the present invention. Examples of gases that may be used in this invention are air, oxygen, hydrogen, carbon dioxide, inert gas, stack gas, steam, anhydrous ammonia, natural gas, ethane, propane and butane. Also, although no additives must be combined with the fluid to be injected, the addition of additives may enhance the recovery process. Less heat is lost through condensation, and the average temperature of the formation is raised at a faster rate than in the prior art. Thus, the increased injection rates yield higher production rates, which improve the economics of the recovery operation.

It is also within the concept of this invention to utilize in situ combustion to achieve or enhance vertical drive of the oil toward horizontal recovery laterals. For instance, if horizontal laterals are placed near the bottom of the formation, in situ combustion near the top of the formation will tend to drive the oil downward. Air or oxygen for the combustion process may be injected via either conventional vertical injection wells from the surface to the upper portion of the formation or horizontal laterals from the mine shaft. Referring to FIGS. 5 and 6, if desired air or oxygen may be injected via the odd-numbered vertical wells, and in situ combustion used to recover oil from the even-numbered vertical wells as the combustion process drives the oil in the upper portion of the formation horizontally. After in situ combustion has progressed in a horizontal direction and the producing even-numbered vertical wells become heated, all the conventional vertical wells 102 through 109 may be used to inject air or oxygen. Thus, in situ combustion may thereafter be utilized to drive the oil downward for recovery by the laterals or boreholes 112 through 119. If desired, this latter operation may be conducted in rotating segments, rather than exploiting the entire area at one time, which would reduce the capital investment required for the air or oxygen compressors.

Alternatively, in situ combustion may be conducted in the upper portion of the formation between conventional vertical wells, as previously described, and thereafter another fluid such as water, steam, inert gas or mixtures thereof injected into all the vertical wells for driving the oil downward for recovery by the horizontal laterals. If desired, the lower horizontal laterals may be initially steam soaked or soaked at intervals during the driving process to maintain the desired recovery flow. The in situ combustion between the conventional vertical wells may be conducted until enough heat has been added to the formation for an efficient oil recovery by subsequent vertical drive techniques. If water is injected into the formation as the driving fluid from the vertical conventional wells, the residual heat from the "burned out" zones may generate steam in situ which may efficiently drive the remaining oil downward for recovery by the laterals.

The above operation is especially attractive from an economic standpoint since little or no surface fuel is used to heat the formation. Temperatures in the combustion zone may be 800° F. to 1000° F. or more, and very good drive of heavy oil can be achieved if the oil in the formation is heated to 250° to 300° F. Also, creating a blanket of combustion-cleaned matrix establishes extremely high vertical downward transmissibility for the injected fluids used in the subsequent driving cycle. In situ combustion further dehydrates and breaks down any shale layers or lenses within the combustion zone.

The recovery of oil when utilizing vertical drive, as described according to my invention, may be further enhanced by reducing the pressure at the recovery laterals to a sub-atmospheric value by connecting the recovery laterals to suction-type pumps. In this manner, oil recovery may be enhanced regardless of whether the vertical drive is propagated by in situ combustion, steam injection, solvent injection, gas injection, or injection of any number of fluids commonly used to enhance the driving operation.

The injection laterals in the embodiments described are preferably positioned in a substantially horizontal plane. The laterals may be inclined to conform to the inclination of the barrier layer, but the injection laterals with the injected fluid principally serve to establish a uniform, substantially horizontal blanket to be driven vertically through the formation. The recovery laterals are generally positioned in a similar substantially horizontal plane so that the formation may be efficiently swept of oil. Some deviation of the laterals is expected, and in that sense the upper and lower laterals may not lie precisely in flat planes. Further, the laterals typically lie in relatively thin discs approximately five feet thick, and these discs or "planes" may be inclined slightly to conform to the barrier layers.

It may also be seen that the present invention may be profitably employed by installing a plurality of vertical mine shafts and laterals, as described herein. Also, by operating such multiple installations in a simultaneous manner, as more fully described in my co-pending patent application, Ser. No. 940,390, an entire field may be drained in a systematic manner.

It may be that two or more oil bearing formations exist at different elevations. In such a case, it is within the concept of my invention that a vertical mine shaft may be employed, and upper and lower laterals may extend from the mine shaft into each of the oil bearing formations.

As hereinbefore described, the techniques of the present invention are principally directed to recovery of relatively heavy oils. However, it should be noted that these techniques are not limited to heavy oils only, but can be used with substantial affect in recovering hydrocarbons of various weights and gravities.

Other alternate forms of the present invention will suggest themselves from a consideration of the apparatus and practices hereinbefore discussed. Accordingly, it should be clearly understood that the systems and techniques depicted in the accompanying drawings, and described in the foregoing explanation, are intended as exemplary embodiments of my invention, and not as limitations thereto.

What I claim is:

1. A method of recovering oil from a subsurface earth formation, comprising:

establishing a shaft of oil extending from the surface to said subsurface earth formation;

drilling a first plurality of boreholes radially from said shaft hole in a substantially horizontal plane within an upper portion of said formation;

drilling a second plurality of boreholes radially from said shaft hole in another substantially horizontal plane within a lower portion of said formation;

introducing a displacing fluid through one of said plurality of boreholes and into said formation for forming a substantially horizontal blanket of displacing fluid;

injecting a driving fluid through said one of said plurality of boreholes and into said formation along at least a substantial portion of each of said one of said plurality of boreholes for vertically driving said displacing fluid through said formation;

withdrawing oil from the other of said plurality of boreholes while injecting said driving fluid into said formation;

monitoring recovery of said driving fluid from each of said other of said plurality of boreholes; and injecting a liquid comprising substantially water through selected ones of said other of said plurality of boreholes in response to recovery of said driving fluid from each of said other of said plurality of boreholes for inhibiting further recovery of said driving fluid.

2. A method as defined in claim 1, further comprising:

thereafter injecting another driving fluid through said other of said plurality of boreholes for driving said oil vertically toward said one of said plurality of boreholes; and recovering oil from said one of said plurality of boreholes while injecting said another driving fluid into said formation.

3. A method of recovering oil from a subsurface earth formation, comprising:

establishing a shaft hole extending from the surface to said subsurface earth formation;

drilling a first plurality of boreholes radially from said shaft hole in a substantially horizontal plane within an upper portion of said formation;

drilling a second plurality of boreholes radially from said shaft hole in another substantially horizontal plane within a lower portion of said formation;

simultaneously introducing a displacing fluid comprising substantially steam through each of said first plurality of boreholes and into said formation for forming a substantially horizontal blanket of displacing fluid;

subsequently injecting a driving fluid through each of said first plurality of boreholes and into said formation along at least a substantial portion of each of said first plurality of boreholes for vertically driving said displacing fluid through said formation; and withdrawing oil from said second plurality of boreholes while injecting said driving fluid into said formation.

4. A method as defined in claim 3, wherein said driving fluid comprises substantially a non-condensible gas.

5. A method as defined in claim 3, wherein injecting said driving fluid further comprises:

generating a pressure differential of at least 100 PSI with said injected fluid between said first plurality of boreholes and said second plurality of boreholes; and maintaining said pressure differential while driving said oil vertically toward said second plurality of boreholes.

6. A method as defined in claim 3, further comprising:

injecting a soaking fluid through said second plurality of boreholes and into said formation until said soaking fluid reaches one or more of said first plurality of boreholes and wherein; and wherein the step of injecting said soaking fluid precedes injection of said displacing fluid.

7. A method of recovering oil from a subsurface earth formation, comprising:

establishing a shaft hole extending from the surface of the earth to said subsurface earth formation;

drilling a first plurality of boreholes radially from said shaft hole in a substantially horizontal plane at a first elevation in a lower portion of said formation;

drilling a second plurality of boreholes from the surface of the earth into said formation and terminating at a substantially uniform second elevation in an upper portion of said formation;

introducing a displacing fluid comprising substantially steam through said second plurality of boreholes and into said formation for forming a substantially horizontal blanket of introduced fluid at said second elevation;

injecting a driving fluid through said second plurality of boreholes and into said formation for driving said oil vertically toward said first plurality of boreholes; and recovering said oil from said first plurality of boreholes while injecting said driving fluid into said formation.

8. A method as defined in claim 7, wherein said driving fluid comprises substantially a non-condensible gas.

9. A method as defined in claim 7, further comprising:

monitoring recovery of said driving fluid from each of said first plurality of boreholes; and injecting a liquid comprising substantially water through selected ones of said first plurality of boreholes in response to recovery of said driving fluid from each of said first plurality of boreholes for inhibiting further recovery of said driving fluid.

10. A method as defined in claim 7, further comprising;

thereafter injecting another driving fluid through said first plurality of boreholes and into said formation for driving said oil vertically toward said second plurality of boreholes; and recovering oil from said second plurality of boreholes while injecting said another driving fluid into said formation.

11. A method as defined in claim 7, further comprising:

prior to the step of injecting said displacing fluid, injecting a soaking fluid through said first plurality of boreholes and into said formation until said soaking fluid reaches one or more of said second plurality of boreholes; and wherein the step of injecting said driving fluid through said second plurality of boreholes and into said formation comprises:

generating a pressure differential of at least 100 psi with said injected driving fluid within said formation between said first plurality of boreholes and said second plurality of boreholes; and maintaining said pressure differential while driving said oil toward said first plurality of boreholes.

12. A method of recovering oil from a subsurface earth formation, comprising:

establishing a shaft hole extending from the surface of the earth to said subsurface earth formation;

drilling a first plurality of boreholes radially from said shaft hole in a substantially horizontal plane at a first elevation in an upper portion of said formation;

drilling a second plurality of boreholes from the surface of the earth into said formation and terminating at a substantially uniform second elevation in a lower portion of said formation;

introducing a displacing fluid comprising substantially steam through said second plurality of boreholes and into said formation for forming a substantially horizontally blanket of introduced fluid at said second elevation;

injecting a driving fluid through said second plurality of boreholes and into said formation for driving said oil vertically towards said first plurality of boreholes; and recovering said oil from said first plurality of boreholes while injecting said driving fluid into said formation.

13. A method as defined in claim 12, further comprising:

monitoring recovery of said driving fluid from each of said first plurality of boreholes; and injecting a liquid comprising substantially water through selected ones of said first plurality of boreholes in response to recovery of said driving fluid from each of said first plurality of boreholes for inhibiting further recovery of said driving fluid.

14. A method of recovering oil from a subsurface earth formation, comprising:

establishing a shaft hole extending from the surface of the earth to said subsurface earth formation;

drilling a first plurality of boreholes radially from said shaft hole in a substantially horizontal plane at a first elevation in a lower portion of said formation;

drilling a second plurality of boreholes from the surface of the earth into said formation and terminating at a substantially uniform second elevation in the lower portion of said formation;

introducing a displacing fluid comprising substantially steam through said second plurality of boreholes and into said formation for forming a substantially horizontal blanket of introduced fluid;

injecting a driving fluid through said second plurality of boreholes and into said formation for driving said oil vertically toward said first plurality of boreholes; and recovering said oil from said first plurality of boreholes while injecting said driving fluid into said formation.

* * * * *

UNITED STATES PATENT AND TRADEMARK OFFICE

CERTIFICATE OF CORRECTION

PATENT NO. : 4,410,216

DATED : October 18, 1983

INVENTOR(S) : Joseph C. Allen

It is certified that error appears in the above-identified patent and that said Letters Patent is hereby corrected as shown below:

In claim 1, line 3 (column 16, line 59) "of oil" should read -- hole --.

Signed and Sealed this

*Thirty-first* Day of *July 1984*

[SEAL]

*Attest:*

GERALD J. MOSSINGHOFF

*Attesting Officer*

*Commissioner of Patents and Trademarks*